US011090777B1

(12) United States Patent
Bannayan et al.

(10) Patent No.: US 11,090,777 B1
(45) Date of Patent: Aug. 17, 2021

(54) SYSTEM FOR TRACKING MOVEMENT OF WORKPIECE DURING GRINDING

(71) Applicant: GLEBAR ACQUISITION, LLC, Ramsey, NJ (US)

(72) Inventors: John Bannayan, New York, NY (US); Robert C. Gleason, Butler, NJ (US)

(73) Assignee: Glebar Acquisition, LLC, Ramsey, NJ (US)

( * ) Notice: Subject to any disclaimer, the term of this patent is extended or adjusted under 35 U.S.C. 154(b) by 356 days.

(21) Appl. No.: 15/427,655

(22) Filed: Feb. 8, 2017

Related U.S. Application Data

(60) Provisional application No. 62/293,087, filed on Feb. 9, 2016.

(51) Int. Cl.

| | |
|---|---|
| ***B24B 5/38*** | (2006.01) |
| ***B24B 5/30*** | (2006.01) |
| ***B24B 9/12*** | (2006.01) |
| ***B24B 49/12*** | (2006.01) |

(52) U.S. Cl.
CPC ..... *B24B 5/38* (2013.01); *B24B 5/30* (2013.01); *B24B 49/12* (2013.01)

(58) Field of Classification Search
CPC .. B24B 5/18; B24B 5/313; B24B 5/32; B24B 5/35; B24B 5/355; B24B 5/36; B24B 5/38; B24B 5/30; B24B 5/307; B24B 5/26; B24B 49/12; B23Q 17/2409; G01B 11/10; G01B 11/06; G01B 11/12; G06T 7/246

See application file for complete search history.

(56) References Cited

U.S. PATENT DOCUMENTS

| | | | | |
|---|---|---|---|---|
| 1,456,462 A * | 5/1923 | Reeves | B24B 5/18 | 451/242 |
| 1,483,748 A * | 2/1924 | Sanford | B24B 5/18 | 451/242 |
| 1,568,185 A * | 1/1926 | Rogers | B24B 5/18 | 451/241 |
| 5,674,106 A * | 10/1997 | Cheetham | B24B 5/18 | 451/14 |
| 6,067,367 A * | 5/2000 | Nakajima | H04N 13/239 | 382/103 |
| 6,144,892 A * | 11/2000 | Cheetham | B24B 5/18 | 451/11 |
| 6,244,930 B1 * | 6/2001 | Archilla | B24B 5/18 | 451/5 |

(Continued)

*Primary Examiner* — Orlando E Aviles
*Assistant Examiner* — Joel D Crandall
(74) *Attorney, Agent, or Firm* — Venable LLP

(57) ABSTRACT

A system for tracking workpiece movement during grinding of the workpiece includes a track, a motorized carriage movably mounted on the track, a detector, and a controller. A position of the carriage is determined by an encoder of the track. The detector is mounted on the carriage and includes a detection window and a sensor. The sensor detects a workpiece edge during grinding by detecting an image of the workpiece edge in the detection window. The controller determines a grinding position of the workpiece based on position data received from the carriage and edge data received from the detector. The controller controls the carriage to move in a forward direction or in a reverse direction to maintain the position of the image of the workpiece edge in the detection window.

26 Claims, 4 Drawing Sheets

(56) References Cited

U.S. PATENT DOCUMENTS

| | | | | |
|---|---|---|---|---|
| 6,312,314 | B2 * | 11/2001 | Cheetham | B24B 5/38 451/243 |
| 2005/0148288 | A1 * | 7/2005 | Memmelaar, Sr. | B24B 5/18 451/11 |
| 2008/0132149 | A1 * | 6/2008 | Hwang | B24B 17/04 451/6 |
| 2009/0186565 | A1 * | 7/2009 | Memmelaar, Sr. | B24B 7/12 451/332 |

* cited by examiner

INITIALIZATION OF LEADING EDGE L OF WORKPIECE 110 RELATIVE TO REFERENCE LINE 114

TRACKING OF TRAILING EDGE T OF WORKPIECE 110 IN ALIGNMENT WITH REFERENCE LINE 114

SYSTEM FOR TRACKING MOVEMENT OF WORKPIECE DURING GRINDING

CROSS-REFERENCE TO RELATED APPLICATION(S)

This application claims the benefit of priority of U.S. Provisional Application No. 62/293,087 filed on Feb. 9, 2016, the entire contents of which is incorporated herein by reference.

FIELD OF THE INVENTION

The present invention relates to generally to an apparatus that tracks movement of a workpiece during grinding of the workpiece. More specifically, the present invention relates to a movable detection system that detects an edge of workpiece to be ground, and that and moves in forward and reverse directions along with the workpiece to track the workpiece during grinding.

RELATED ART

Centerless outside-diameter or "OD" grinders are commonly used to remove material from an outer surface of raw material (e.g., wire stock), to produce a ground article having a circular radial cross section and a longitudinal cross section that can take on various profiles, e.g., tapered, saw-toothed, etc.

A notable drawback of conventional centerless OD grinders is the difficulty in producing ground articles having precise dimensions in a reproducible manner. That is, the ability to mass produce ground articles having tight tolerances, and the ability to predictably produce such articles at will, have been a challenge.

One solution that has been proposed is described in U.S. Pat. No. 5,480,342. This solution utilizes a series of photoelectric sensors to detect the movement of the trailing edge of a piece of wire or feedstock as it is being ground. Each sensor is positioned along a line parallel to the line of travel of the feedstock, and the sensors are spaced apart at known distances. As the trailing edge goes past a sensor, that sensor produces a signal that is sent to a microprocessor, which calculates the feed rate based on the known distance between each sensor and the times at which the trailing edge passes each sensor. The feed rate is used to control the position of a regulating wheel of the centerless OD grinder to thereby control the diameter of the feedstock along its length during grinding.

The solution described in U.S. Pat. No. 5,480,342, however, requires the use of a linear array of multiple, closely spaced sensors in order to be able to detect small advances of the trailing edge of the workpiece during grinding. With such an arrangement, the costs associated with deploying and maintaining the sensors can be high.

Another solution is described in U.S. Pat. No. 7,429,208, which discloses a mechanism for controlling the movement of feedstock during grinding by using collet assemblies. Collets of the collet assemblies selectively grip and release the feedstock under the control of a computer processor. The collets of the collet assemblies are linearly transported by a motor assembly, such that the feedstock can be continuously and controllably pulled in a linear or longitudinal manner during grinding, backwards and forwards, without the need for monitoring the endpoint of the feedstock. Moreover, through use of the collet assemblies, the feedstock can be held and rotated about a longitudinal grinding axis of the feedstock during grinding, with the longitudinal or linear movement of the feedstock as well as the rotation speed of the feedstock being controlled by the computer processor to repeatably produce ground articles having the same dimensions. An example of a grinding system that utilizes such collet assemblies is the CAM.2 Micro Grinding System (Glebar Company, Ramsey, N.J.).

With the computer-controlled collet assemblies and motor assembly taught in U.S. Pat. No. 7,429,208, more than one collet assembly is required to be controlled and maintained, which necessitates the use of a complex control system and increases the number of moving parts that need to be monitored and kept in good working order.

BRIEF DESCRIPTION OF THE INVENTION

Aspects of the present invention provide a tracking system that movably tracks movement of a workpiece during grinding of the workpiece. The tracking system moves in forward and reverse directions to track forward and reverse movement of the workpiece during grinding. The tracking system may be used with grinders to monitor a position of the workpiece during grinding.

For example, the tracking system may be used with a centerless grinder in which movement of a workpiece is based on position of a regulating wheel of the grinder relative to a grinding wheel of the grinder. With such a system, the speed and direction of movement of the workpiece is a function of, among other things, a rotation speed of the regulating and grinding wheels, as well as an angular position of the regulating wheel with respect to the grinding wheel. When the workpiece is to be ground to have a complex profile, the tracking system may be used to accurately monitor in real time an edge of the workpiece during grinding, to determine a linear position on the workpiece that is currently being ground, and to provide the linear position to a servo controller of the grinder so that the servo controller can adjust a position of the grinding wheel and/or the regulating wheel so that a desired profile can be produced, such as a desired taper, a desired step, a desired trench, etc.

In another example, the tracking system may be a collet-based system in which a collet is used to hold, rotate, and linearly move a workpiece during grinding. Instead of monitoring movement of the collet, the tracking system may be used to accurately monitor in real time an edge of the workpiece during grinding, similar to the monitoring discussed above for a centerless grinder.

In an aspect of the invention, a system for tracking movement of a workpiece during grinding includes: a linear track positioned parallel to a longitudinal axis of movement of the workpiece, the track being equipped with an encoder system; a motorized carriage movably mounted on the track, the carriage being structured for forward movement and reverse movement on the track, a position of the carriage along the track being determined by the encoder system; an optical detector mounted on the carriage, the optical detector having a detection window and a sensor, the sensor being configured to detect an edge of the workpiece as the workpiece moves longitudinally along the axis of movement during grinding by a grinding system, the edge of the workpiece being detected by the sensor when an image of the edge of the workpiece enters the detection window; and a controller arranged to control the grinding system and the carriage based on position data received from the carriage and edge data received from the optical detector, the position data corresponding to the position of the carriage along the track, and the edge data corresponding to a position of the image of the edge of the workpiece in the detection window. The controller controls the carriage to move in a forward direction or in a reverse direction to maintain the position of the image of the edge of the workpiece in the detection window. Also, the controller controls a position of a grinding wheel of the grinding system relative to the workpiece, based on the position of the carriage along the track. With this tracking system, a single computer may be used to control a tracking and grinding operations.

In another aspect, a system for tracking movement of a workpiece during grinding includes: a linear track positioned parallel to a longitudinal axis of movement of the workpiece, the track being equipped with an encoder system; a motorized carriage movably mounted on the track, the carriage being structured for forward movement and reverse movement on the track, a position of the carriage along the track being determined by the encoder system; an optical detector mounted on the carriage, the optical detector having a detection window and a sensor, the sensor being configured to detect an edge of the workpiece as the workpiece moves longitudinally along the axis of movement during grinding by a grinding system, the edge of the workpiece being detected by the sensor when an image of the edge of the workpiece enters the detection window; and a control system arranged to determine a grinding position of the workpiece relative to the edge of the workpiece based on position data received from the carriage and edge data received from the optical detector, the position data corresponding to the position of the carriage along the track, and the edge data corresponding to a position of the image of the edge of the workpiece in the detection window. The control system controls the carriage to move in a forward direction or in a reverse direction to maintain the position of the image of the edge of the workpiece in the detection window. The control system transmits data on the grinding position of the workpiece to a servo controller of the grinding system, to enable the servo controller to adjust a wheel position of the grinding system. With this tracking system, grinding operations are controlled by a separate controller (i.e., the servo controller), which is provided with information from the control system of the tracking system.

BRIEF DESCRIPTION OF THE DRAWINGS

The present invention will be more readily understood from a detailed description of embodiments of the invention considered in conjunction with the attached drawings, of which.

DETAILED DESCRIPTION OF EMBODIMENTS OF THE INVENTION

First Embodiment

Figure 1:
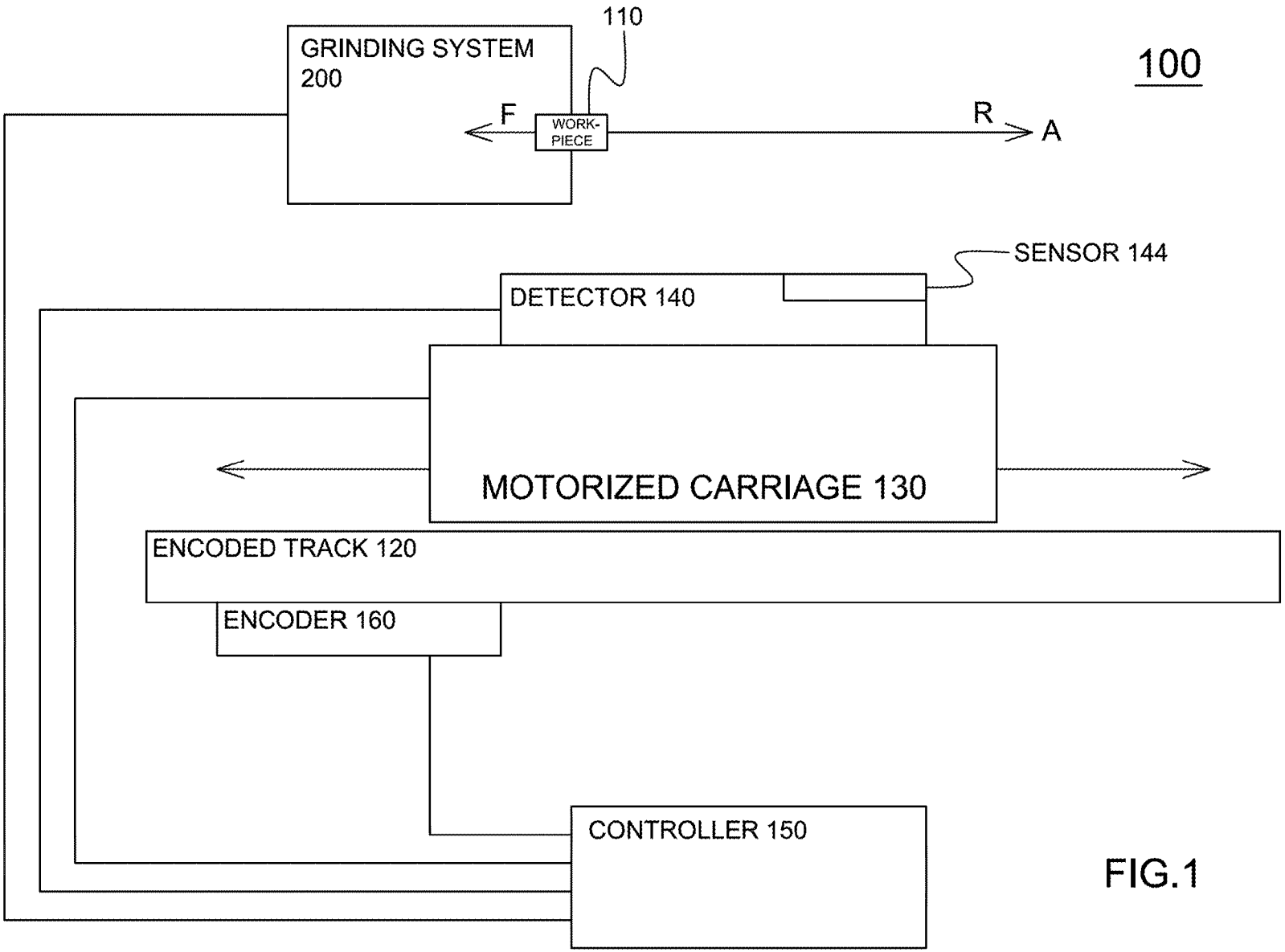
FIG. 1 schematically shows a tracking system according to an embodiment of the invention.

FIG. 1 schematically shows a system (100) for tracking movement of a workpiece (110) during machine grinding of the workpiece (110) according to a first embodiment. The system (100) includes a linear track (120), a motorized carriage (130), an optical detector (140), and a controller (150).

The track (120) is positioned parallel to a longitudinal axis of movement (A) of the workpiece (110). The track (120) is equipped with an encoder system (160). The encoder system (160) correlates a position on the track (120) with a distance measurement. The carriage (130) is mounted on the track (120) and is motorized and structured for forward movement (F) and reverse movement (R) on the track (120). A position of the carriage (130) along the track (120) is determined by the encoder system (160).

Figure 2:
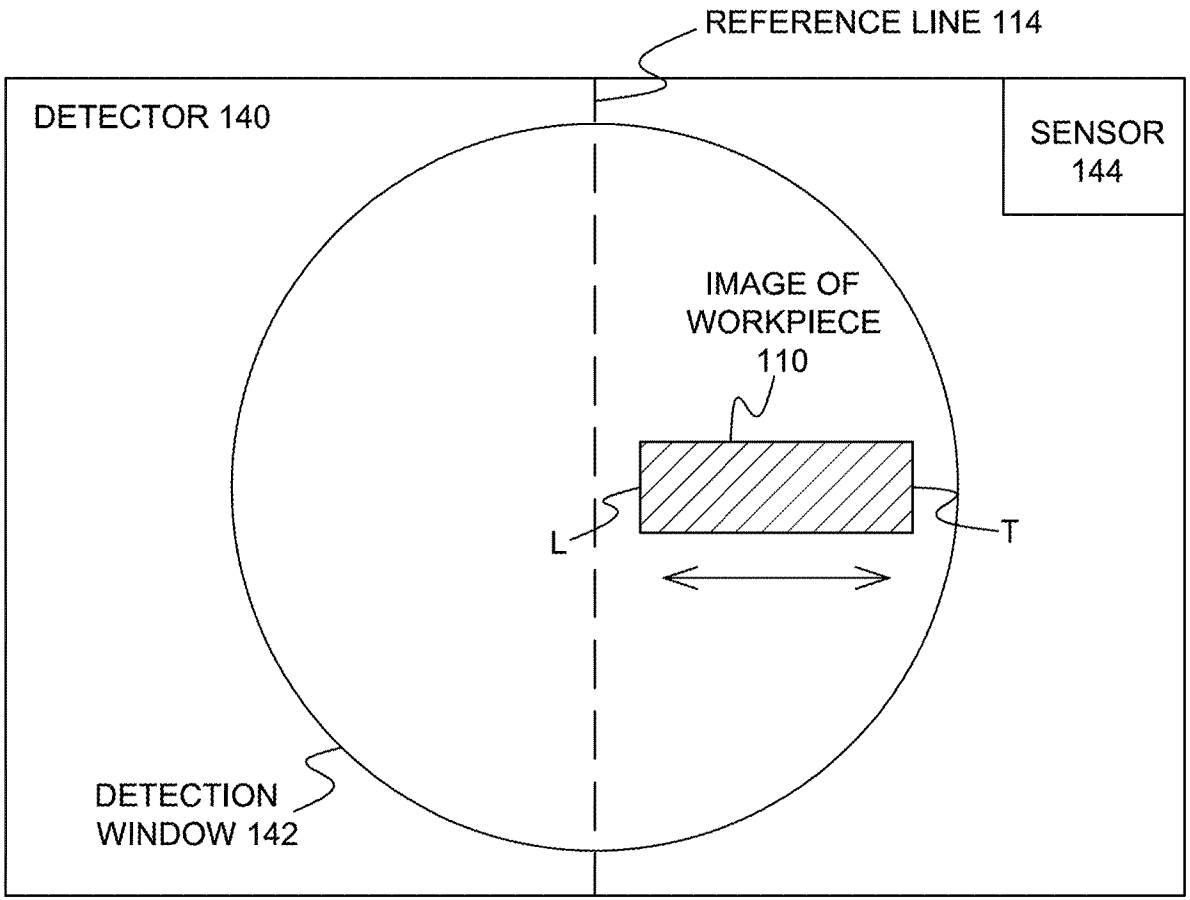
FIG. 2 schematically shows a detector and its detection window according to an embodiment of the invention.

The optical detector (140) is mounted on the carriage (130) such that forward and reverse movement of the carriage (130) along the track (120) moves the optical detector (140). The optical detector (140) includes a detection window (142) and a sensor (144), schematically shown in FIGS. 2 and 3. For example, the optical detector (140) may be a digital camera, and the detection window (142) may be a field of view of the camera. The sensor (144) may be an image sensor programmed with an edge detection algorithm to detect an edge (L and/or T) of the workpiece (110) as the workpiece (110) moves longitudinally along the axis of movement (A) into the detection window (142) during grinding. FIG. 2 schematically depicts the detection window (142) showing an image of the edge (L) and the edge (T) of the workpiece (110) relative to a reference line (114).

During an initialization process, the edge (L) of the workpiece (110) is brought into the field of view of the camera, such that the image of the edge (L) appears in the detection window (142). When the image of the edge (L) coincides with the reference line (114), the sensor (144) detects and registers the alignment and determines the image of the edge (L) to be a zero point along the length of the workpiece (110). The zero point is correlated to an encoder position of the encoder system (160). The edge (T) also is detected and correlated to an end point along the length of the workpiece (110). Either the edge (L) or the edge (T) is tracked, or both may be tracked. Preferably, the edge (T) is tracked and therefore the following discussion is with respect to the edge (T).

The controller (150) may be a general-purpose computer or microprocessor programmed with algorithms to carry out the procedures described herein. Alternatively, the controller (150) may be a dedicated device having circuitry specifically designed and programmed to carry out the procedures described herein.

The controller (150) controls a grinding system (200) and movement of the carriage (130) based on position data received from the carriage (130) and edge data received from the optical detector (140). The position data corresponds to the position of the carriage (130) along the track (120) as determined by the encoder system (160), and the edge data corresponds to a position of the image of the edge (T) of the workpiece (110) in the detection window (142). Optionally, the position data may be transmitted to the controller (150) from the encoder system (160).

The controller (150) controls the carriage (130) to move in a forward direction or in a reverse direction to maintain the position of the image of the edge (T) of the workpiece (110) in the detection window (142) and aligned with the reference line (114). For example, if the image of the edge (T) of the workpiece advances in a first direction in the detection window (142) such that the image of the edge (T) no longer aligns with the reference line (114), the controller (150) controls the carriage (130) to move in the forward direction so that the image of the edge (T) realigns with the reference line (114). Similarly, if the image of the edge (T) advances in a second direction opposite to the first direction, such that the image of the edge (T) no longer aligns with the reference line (114), the controller (150) controls the carriage (130) to move in the reverse direction so that the image of the edge (T) realigns with the reference line (114). Movement of the carriage (130) along the track (120) causes the position data of the carriage (130) to change. The difference between the zero point (or the end point) and the position data of a current position of the carriage (130) during grinding, when the image of the edge (T) is aligned with the reference line (114), correlates to the distance along the length of the workpiece (110) at which the workpiece is (110) being ground.

The controller (150) controls a relative position of a grinding wheel (no shown) of the grinding system (200) based on the position of the carriage (130) along the track (120).

In an aspect of the first embodiment, the encoder system (160) is a micron encoder system that outputs position data having a resolution of less than 10 μm. In another aspect, this resolution is less than 5 μm. In yet another aspect, this resolution is approximately 1 μm.

In an aspect of the first embodiment, the optical detector is a digital camera. For example, the digital camera may be a CCD camera.

In an aspect of the first embodiment, the controller (150) controls the carriage (130) to move in the forward direction or in the reverse direction to maintain the position of the image of the edge (T) of the workpiece (110) at a predetermined range of locations in the detection window (142) instead of aligned with the reference line (114).

In an aspect of the first embodiment, the controller (150) is programmed to calculate a longitudinal position of the grinding wheel relative to the edge (T) of the workpiece (110) based on one or both of: the position data corresponding to the position of the carriage (130) along the track (120), and the edge data corresponding to the position of the image of the edge (T) in the detection window (142).

In an aspect of the first embodiment, the controller (150) is programmed to control the lateral position of the grinding wheel based on the longitudinal position of the grinding wheel (210) relative to the edge of the workpiece (110).

In an aspect of the first embodiment, the grinding system (200) controlled by the controller (150) is a centerless grinding system. The controller (150) is programmed to calculate a longitudinal position of the grinding wheel of the grinding system (200) relative to the edge (T) of the workpiece (110) based on one or both of: the position data corresponding to the position of the carriage (130) along the track (120), and the edge data corresponding to the position of the image of the edge of the workpiece (T) in the detection window (142). The controller (150) additionally is programmed to control a spacing between the grinding wheel and a regulating wheel (not shown) based on the longitudinal position of the grinding wheel (210) relative to the edge (T) of the workpiece (110). Alternatively, the centerless grinding system does not include a regulating wheel, and the controller (150) controls a position of the grinding wheel relative to the workpiece (110) during grinding.

In an aspect of the first embodiment, the grinding system (200) controlled by the controller (150) is an OD-type grinding system.

Figure 3:
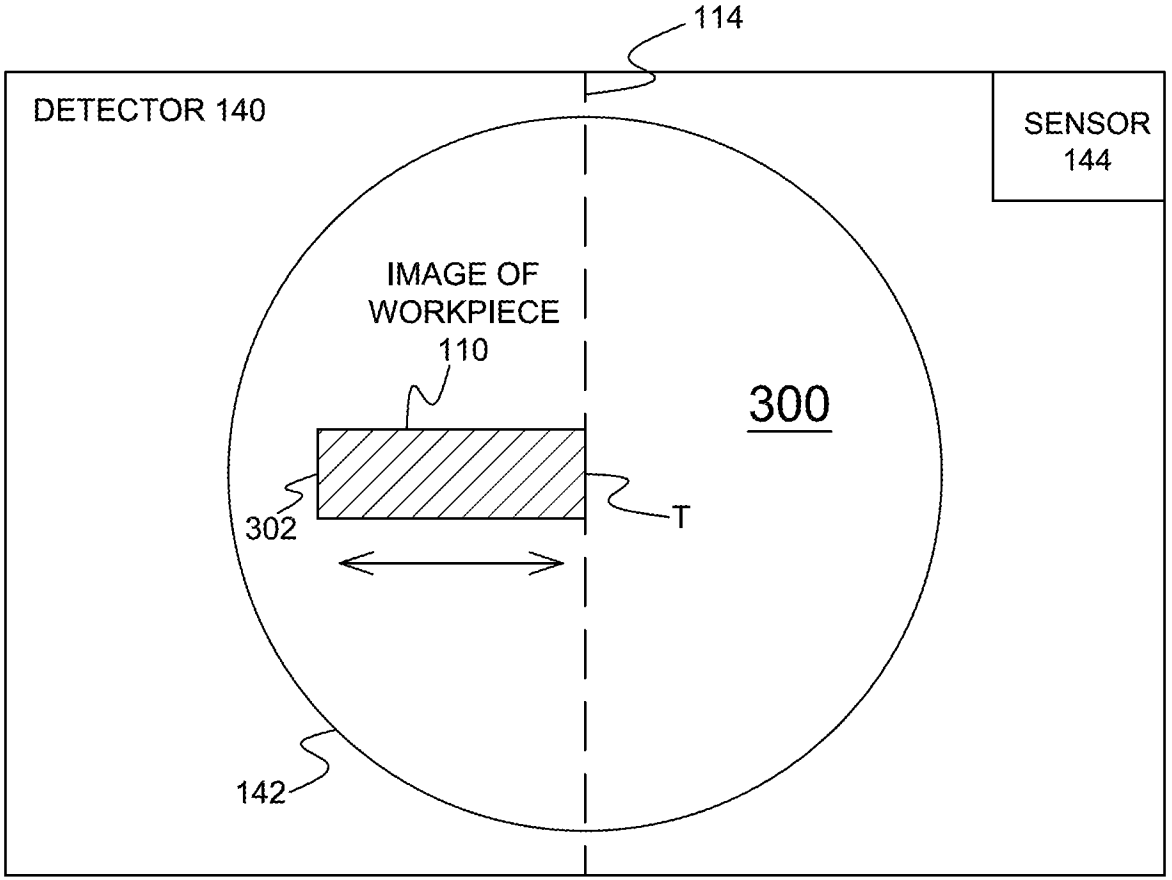
FIG. 3 schematically shows a detector and its detection window according to an embodiment of the invention.

In an aspect of the first embodiment, the image of the edge of the workpiece (110) is sensed by the sensor (144) to correspond to a transition between a light region (300) and a dark region (302) in the detection window (142), as schematically shown in FIG. 3. As will be appreciated by persons skill in the art of image processing, known edge-detection algorithms may be utilized by the sensor (144) and/or the controller (150) to detect an edge in an image.

In an aspect of the first embodiment, the controller (150) is programmed to control the carriage (130) to move at a speed corresponding to a speed of the workpiece (110) moving along the axis of movement (A). The speed may be a constant speed or a variable speed, and the carriage (130) may be controlled by the controller (150) to stop intermittently to, for example, grind a ledge in the workpiece (110), or to change directions to and from the forward and reverse directions.

In an aspect of the first embodiment, the grinding system (200) controlled by the controller (150) is a centerless grinding system. The controller (150) controls the carriage (130) to move in the forward direction when the position of the image of the edge (T) of the workpiece (110) moves in a first direction relative to a predetermined location in the detection window (142), and to move in the reverse direction when the position of the image of the edge (T) of the workpiece (110) moves in a second direction relative to the predetermined location in the detection window (142), with the second direction being opposite to the first direction. Optionally, the controller (150) controls a tilt angle of a regulating wheel (not shown) of the centerless grinding system to cause the workpiece (110) to change between the forward direction and the reverse direction.

Second Embodiment

Figure 4:
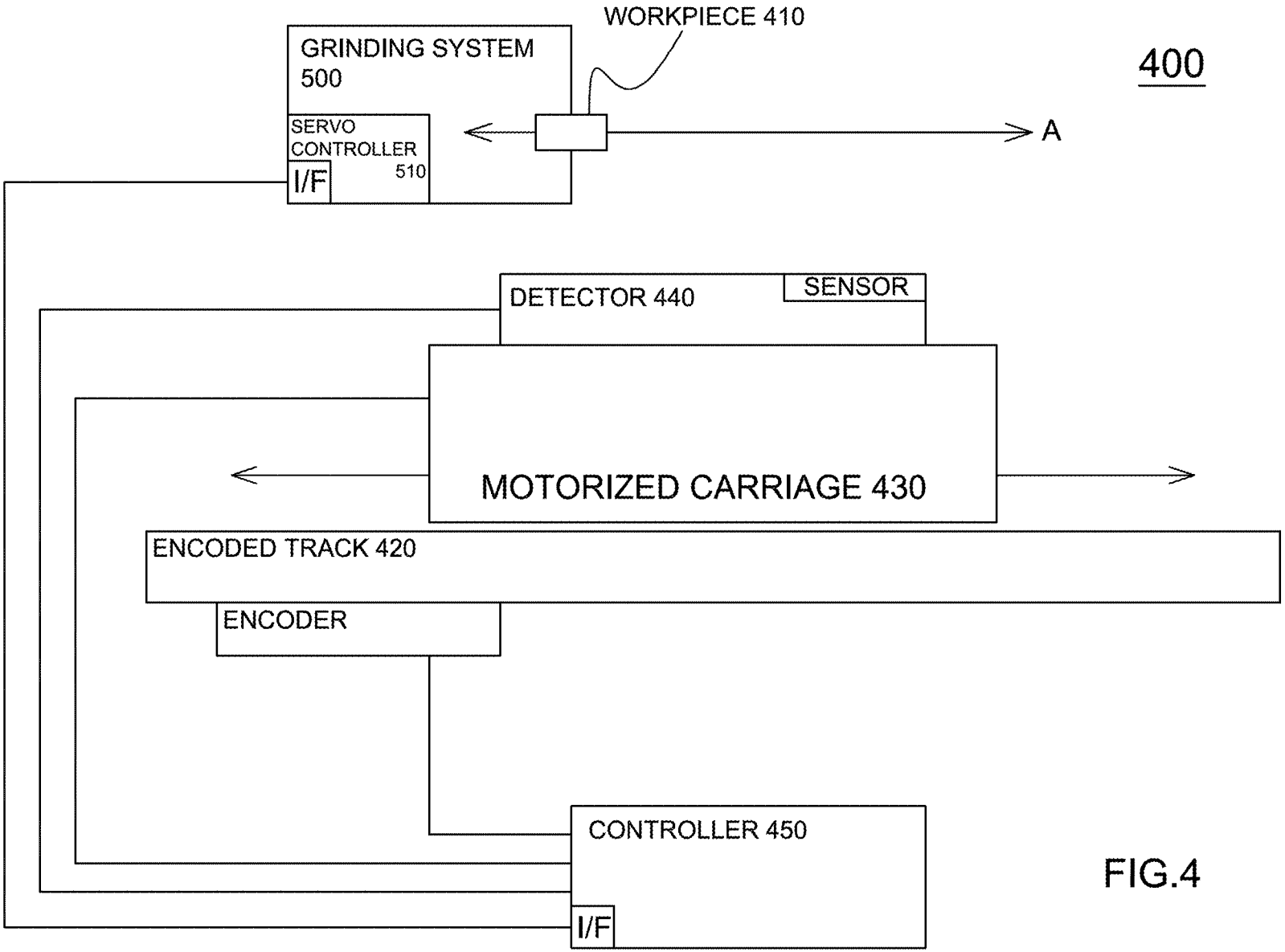
FIG. 4 schematically shows a tracking system according to an embodiment of the invention.

FIG. 4 schematically shows a system (400) for tracking movement of a workpiece (410) during machine grinding of the workpiece (410) according to a second embodiment. The system (400) includes a linear track (420), a motorized carriage (430), an optical detector (440), and a control system (450).

In many respects, the system (400) is similar to the system (100) except that the control system (450) does not directly control a grinding system (500) but instead transmits data to a servo controller (510) of the grinding system (500). In turn, the servo controller (510) receives and processes the data received from the control system (450) to control the grinding system 500.

The data transmission can be accomplished by known transmission technologies. For example the transmission may be via an Ethernet connection, or a dedicated cable such as a USB cable, or the like. Optionally, wireless technologies may be used for communication of data from the control system (450) to the servo controller (510) of the grinding system (500).

Finally, the above descriptions are directed to various embodiments of the present invention, and other embodiments not specifically described are within the scope of the present invention.

What is claimed is:

1. A system for tracking movement of a workpiece during machine grinding of the workpiece by a grinding wheel, the system comprising:

a linear track positioned parallel to a longitudinal axis of movement of the workpiece, the track being equipped with an encoder system;

a motorized carriage movably mounted on the track, the carriage being structured for forward movement and reverse movement on the track, a position of the carriage along the track being determined by the encoder system;

an optical detector mounted on the carriage, the optical detector having a detection window and a sensor, the sensor being configured to detect an edge of the workpiece as the workpiece moves longitudinally along the axis of movement during grinding by the grinding wheel, the edge of the workpiece being detected by the sensor when an image of the edge of the workpiece enters the detection window; and a controller arranged to control the grinding wheel and the carriage based on position data of the carriage determined by the encoder system and edge data received from the optical detector, the position data corresponding to the position of the carriage along the track, and the edge data corresponding to a position of the image of the edge of the workpiece in the detection window, wherein the controller is configured to control the carriage to move in a forward direction or in a reverse direction to maintain the position of the image of the edge of the workpiece in the detection window, and wherein the controller is configured to control the grinding wheel to allow for adjustment of a lateral position of the grinding wheel based on the position of the carriage along the track.

2. The system according to claim 1, wherein the encoder system is a micron encoder system that outputs position data having a resolution of less than 10 μm.

3. The system according to claim 1, wherein the optical detector is a digital camera.

4. The system according to claim 1, wherein the controller is configured to control the carriage to move in the forward direction or in the reverse direction to maintain the position of the image of the edge of the workpiece at a predetermined location in the detection window.

5. The system according to claim 4, wherein the controller is configured to control the carriage to:

move in the forward direction when the position of the image of the edge of the workpiece moves in a first direction relative to the predetermined location in the detection window, and move in the reverse direction when the position of the image of the edge of the workpiece moves in a second direction relative to the predetermined location in the detection window.

6. The system according to claim 1, wherein the controller is programmed to calculate a longitudinal position of the grinding wheel relative to the edge of the workpiece based on one or both of:

the position data corresponding to the position of the carriage along the track, and the edge data corresponding to the position of the image of the edge of the workpiece in the detection window.

7. The system according to claim 6, wherein the controller is programmed to control the lateral position of the grinding wheel based on the longitudinal position of the grinding wheel relative to the edge of the workpiece.

8. The system according to claim 1, wherein the grinding wheel is a part of a centerless grinding system controlled by the controller, wherein the controller is programmed to calculate a longitudinal position of the grinding wheel relative to the edge of the workpiece based on one or both of:

the position data corresponding to the position of the carriage along the track, and the edge data corresponding to the position of the image of the edge of the workpiece in the detection window, and wherein the controller is programmed to control a spacing between the grinding wheel and a regulating wheel of the centerless grinding system based on the longitudinal position of the grinding wheel relative to the edge of the workpiece.

9. The system according to claim 1, wherein the image of the edge of the workpiece is sensed by the sensor to correspond to a transition between light and dark regions in the detection window.

10. The system according to claim 1, wherein the controller is programmed to control the carriage to move at a speed corresponding to a speed of the workpiece moving along the axis of movement.

11. The system according to claim 1, wherein the controller is programmed to control the carriage to move at a variable speed corresponding to a variable speed of the workpiece moving along the axis of movement.

12. The system according to claim 1, wherein the system is operatively connected to a grinding system controlled by the controller, with the grinding system being a centerless grinding system, wherein the controller is configured to control the carriage to:

move in the forward direction when the position of the image of the edge of the workpiece moves in a first direction relative to a predetermined location in the detection window, and move in the reverse direction when the position of the image of the edge of the workpiece moves in a second direction relative to the predetermined location in the detection window, and wherein the controller is configured to control a tilt angle of a regulating wheel of the centerless grinding system to cause the workpiece to change between the forward direction and the reverse direction.

13. A system for tracking movement of a workpiece during machine grinding of the workpiece, the system comprising:

a linear track positioned parallel to a longitudinal axis of movement of the workpiece, the track being equipped with an encoder system;

a motorized carriage movably mounted on the track, the carriage being structured for forward movement and reverse movement on the track, a position of the carriage along the track being determined by the encoder system;

an optical detector mounted on the carriage, the optical detector having a detection window and a sensor, the sensor being configured to detect an edge of the workpiece as the workpiece moves longitudinally along the axis of movement during grinding by a grinding system, the edge of the workpiece being detected by the sensor when an image of the edge of the workpiece enters the detection window; and a control system arranged to determine a grinding position of the workpiece relative to the edge of the workpiece based on position data of the carriage determined by the encoder system and edge data received from the optical detector, the position data corresponding to the position of the carriage along the track, and the edge data corresponding to a position of the image of the edge of the workpiece in the detection window, wherein the control system is configured to control the carriage to move in a forward direction or in a reverse direction to maintain the position of the image of the edge of the workpiece in the detection window, and wherein the control system is configured to transmit data on the grinding position of the workpiece to a servo controller of the grinding system, to enable the servo controller to adjust a wheel position of the grinding system.

14. The system according to claim 13, wherein the wheel position corresponds to a position of a grinding wheel of the grinding system.

15. The system according to claim 13, wherein the wheel position corresponds to a spacing between a grinding wheel and a regulating wheel of the grinding system.

16. The system according to claim 13, wherein the control system is configured to transmit the data on the grinding position to the servo controller via an Ethernet transmission.

17. The system according to claim 13, wherein the control system is configured to transmit the data on the grinding position to the servo controller via a dedicated data cable.

18. The system according to claim 13, wherein the encoder system is a micron encoder system that outputs position data having a resolution of less than 10 μm.

19. The system according to claim 13, wherein the optical detector is a digital camera.

20. The system according to claim 13, wherein the control system is configured to control the carriage to move in the forward direction or in the reverse direction to maintain the position of the image of the edge of the workpiece at a predetermined location in the detection window.

21. The system according to claim 20, wherein the control system is configured to control the carriage to:

move in the forward direction when the position of the image of the edge of the workpiece moves in a first direction relative to the predetermined location in the detection window, and move in the reverse direction when the position of the image of the edge of the workpiece moves in a second direction relative to the predetermined location in the detection window.

22. The system according to claim 13, wherein the control system is programmed to determine the grinding position of the workpiece based on one or both of:

the position data corresponding to the position of the carriage along the track, and the edge data corresponding to the position of the image of the edge of the workpiece in the detection window.

23. The system according to claim 13, wherein the image of the edge of the workpiece is sensed by the sensor to correspond to a transition between light and dark regions in the detection window.

24. The system according to claim 13, wherein the control system is programmed to control the carriage to move at a speed corresponding to a speed of the workpiece moving along the axis of movement.

25. The system according to claim 13, wherein the control system is programmed to control the carriage to move at a variable speed corresponding to a variable speed of the workpiece moving along the axis of movement.

26. A system for tracking movement of a workpiece during machine grinding of the workpiece by a grinding wheel, the system comprising:

a linear track positioned parallel to a longitudinal axis of movement of the workpiece, the track being equipped with an encoder system;

a motorized carriage movably mounted on the track, the carriage being structured for forward movement and reverse movement on the track, a position of the carriage along the track being determined by the encoder system;

an optical detector mounted on the carriage, the optical detector having a detection window and a sensor, the sensor being configured to detect an edge of the workpiece as the workpiece moves longitudinally along the axis of movement during grinding by the grinding wheel, the edge of the workpiece being detected by the sensor when an image of the edge of the workpiece enters the detection window; and a controller arranged to control the grinding wheel and the carriage based on position data of the carriage determined by the encoder system and edge data received from the optical detector, the position data corresponding to the position of the carriage along the track, and the edge data corresponding to a position of the image of the edge of the workpiece in the detection window, wherein the controller is configured to control the carriage to move in a forward direction or in a reverse direction to maintain the position of the image of the edge of the workpiece in the detection window, wherein the controller is configured to control the grinding wheel to allow for adjustment of a lateral position of the grinding wheel based on the position of the carriage along the track, and wherein the encoder system is a micron encoder system that outputs position data having a resolution of less than 1 μm.

* * * * *